US010944142B2

(12) United States Patent
Iwanaka

(10) Patent No.: US 10,944,142 B2
(45) Date of Patent: Mar. 9, 2021

(54) TUNABLE BANDPASS FILTER

(71) Applicant: NEC Corporation, Tokyo (JP)

(72) Inventor: Daisuke Iwanaka, Tokyo (JP)

(73) Assignee: NEC CORPORATION, Tokyo (JP)

( * ) Notice: Subject to any disclaimer, the term of this patent is extended or adjusted under 35 U.S.C. 154(b) by 348 days.

(21) Appl. No.: 16/089,147

(22) PCT Filed: Mar. 23, 2017

(86) PCT No.: PCT/JP2017/011712
§ 371 (c)(1),
(2) Date: Sep. 27, 2018

(87) PCT Pub. No.: WO2017/170120
PCT Pub. Date: Oct. 5, 2017

(65) Prior Publication Data

US 2020/0303796 A1 Sep. 24, 2020

(30) Foreign Application Priority Data

Mar. 31, 2016 (JP) ..... JP2016-072641

(51) Int. Cl.

| | |
|---|---|
| ***H01P 1/205*** | (2006.01) |
| ***H01P 1/208*** | (2006.01) |
| ***H01P 7/04*** | (2006.01) |
| ***H01P 7/10*** | (2006.01) |

(52) U.S. Cl.
CPC ..... *H01P 1/205* (2013.01); *H01P 1/2084* (2013.01); *H01P 7/04* (2013.01); *H01P 7/10* (2013.01)

(58) Field of Classification Search
CPC ..... H01P 1/202; H01P 1/203; H01P 1/20336; H01P 1/205; H01P 1/2053; H01P 7/04; H01P 7/08; H01P 7/082; H01P 7/088; H01P 7/00
USPC ..... 333/203, 205, 206, 207, 209, 202
See application file for complete search history.

(56) References Cited

U.S. PATENT DOCUMENTS

| | | | | |
|---|---|---|---|---|
| 3,597,709 | A * | 8/1971 | Rhodes | H01P 1/205 333/203 |
| 4,990,871 | A * | 2/1991 | Reindel | H01P 1/207 333/209 |
| 2017/0237142 | A1* | 8/2017 | Mansour | H01P 1/2053 333/203 |

FOREIGN PATENT DOCUMENTS

| | | | |
|---|---|---|---|
| JP | 2009-055576 | A | 3/2009 |
| JP | 2012-204844 | A | 10/2012 |
| JP | 2014-049867 | A | 3/2014 |
| JP | 2016-119531 | A | 6/2016 |
| WO | 2010/150815 | A1 | 12/2010 |

(Continued)

OTHER PUBLICATIONS

Written Opinion of the International Searching Authority of PCT/JP2017/011712 dated Jun. 13, 2017.

(Continued)

*Primary Examiner* — Stephen E. Jones
(74) *Attorney, Agent, or Firm* — Sughrue Mion, PLLC

(57) ABSTRACT

This tunable bandpass filter is provided with: a conductive member having a plurality of resonance rods protruding so as to be aligned in a single plane; a dielectric plate disposed parallel to the single plane; a drive part which is attached to the dielectric plate and drives the dielectric plate in directions parallel and perpendicular to the single plane; and a waveguide containing at least the resonance rods and the dielectric plate.

8 Claims, 7 Drawing Sheets

(56) References Cited

FOREIGN PATENT DOCUMENTS

WO 2014/064911 A1 5/2014

OTHER PUBLICATIONS

International Search Report of PCT/JP2017/011712 dated Jun. 13, 2017.

* cited by examiner

TUNABLE BANDPASS FILTER

CROSS REFERENCE TO RELATED APPLICATIONS

This application is a National Stage of International Application No. PCT/JP2017/011712 filed Mar. 23, 2017, claiming priority based on Japanese Patent Application No. 2016-072641 filed Mar. 31, 2016, the entire disclosure of which is incorporated herein.

TECHNICAL FIELD

The present invention relates to a tunable bandpass filter capable of controlling a microwave or millimeter-wave passband width.

BACKGROUND ART

Filters needed in microwave or millimeter-wave band applications typically require low losses. In particular, the requirement is high in devices for acquiring high output. For the purpose of integrating devices having separate bandwidths into a single device, these filters require a variable bandwidth and low losses.

A related art discloses a filter disposed on a Printed Circuit Board (PCB) that is capable of controlling the bandwidth through introduction of an additional variable capacitance by using a varactor diode or the like. However, the filter according to the related art uses a PCB and it is difficult to reduce filter losses in a high-frequency band. Moreover, the filter according to the related art uses a variable capacitance element like a varactor diode, which adds to the losses. Thus, it is extremely difficult for the filter according to the related art to reduce the losses.

There is widely known, in another art, a multi-stage semi-coaxial filter that controls the bandwidth by using movable coupling adjusting screws between adjacent resonators. However, for example, a five-stage semi-coaxial filter must drive total six coupling adjusting screws independently from each other. In this case, generally speaking, the bandwidth is controlled by adjusting the rotation speed of the six coupling adjusting screws by using a motor or the like. A multi-stage filter includes a large number of components, which leads to a complicated structure and a high cost.

Related art filters suffer variations in bandwidth as well as center frequency. For example, in PTL 1 and PTL 2, there is disclosed a technique to control the center frequency or resonance frequency by changing the capacitance between a conductor plate or a dielectric plate and a resonance element. However, PTL 1 or PTL2 does not disclose a technique to control both of the center frequency and the bandwidth.

CITATION LIST

Patent Literature

[PTL 1] WO 2014/064911
[PTL 2] WO 2010/150815

SUMMARY OF THE INVENTION

Technical Problem

The present invention has been created in consideration of the aforementioned problems and it is an object of the present invention to provide a tunable bandpass filter that has low losses and a simple structure and is capable of controlling the bandwidth.

Solution to the Problem

In order to achieve the aforementioned object, a tunable bandpass filter according to an aspect of the present invention includes: a conductive member including a plurality of resonance rods protruding in such a way as to be aligned in a single plane; a dielectric plate disposed parallel to the single plane; a driving unit, attached to the dielectric plate, for driving the dielectric plate in directions parallel and perpendicular to the single plane; and a waveguide containing at least the resonance rods and the dielectric plate.

In order to achieve the aforementioned object, a tunable bandpass filter according to another aspect of the present invention includes: a conductive member; a resonance rod protruding from one surface of the conductive member; a dielectric plate disposed parallel to the one surface; a driving unit for driving the dielectric plate in directions parallel and perpendicular to the one surface; and a waveguide containing at least the resonance rod and the dielectric plate.

Advantageous Effects of the Invention

The tunable bandpass filter according to the present invention is capable of adjusting the position of the dielectric plate with respect to the resonance rod by driving, through use of an actuator or the like, the driving unit attached to the dielectric plate. The driving unit is capable of adjusting the position of the dielectric plate in two directions, that is, in directions parallel and perpendicular to the principal surface thereof. The driving unit is capable of changing the bandwidth through position adjustment in parallel direction and the center frequency through position adjustment in perpendicular direction. Thus, the tunable bandpass filter according to the present invention is capable of controlling only the bandwidth while keeping the center frequency constant.

The tunable bandpass filter according to the present invention is designed to control the bandwidth through position adjustment of the dielectric plate alone. Accordingly, even when a plurality of filters of different bandwidths are integrated into a single filter, it is unnecessary to adjust individual filters by using coupling adjusting screws as opposed to the related art, which offers a simple structure with reduced number of components.

The tunable bandpass filter according to the present invention is designed in such a way as not to use a variable capacitance element such as a varactor diode in the control of the bandwidth, which reduces generation of losses.

EXAMPLE EMBODIMENT

Example embodiments of the present invention will be described, based on attached drawings. In the following description, components having the same function are assigned the same reference sign and overlapping description may be omitted. Further, in the following description, a characteristic portion may be illustrated in enlarged fashion for convenience and the dimension ratio of a component is not necessarily the same as the actual dimension ratio thereof.

First Example Embodiment

Figure 1:
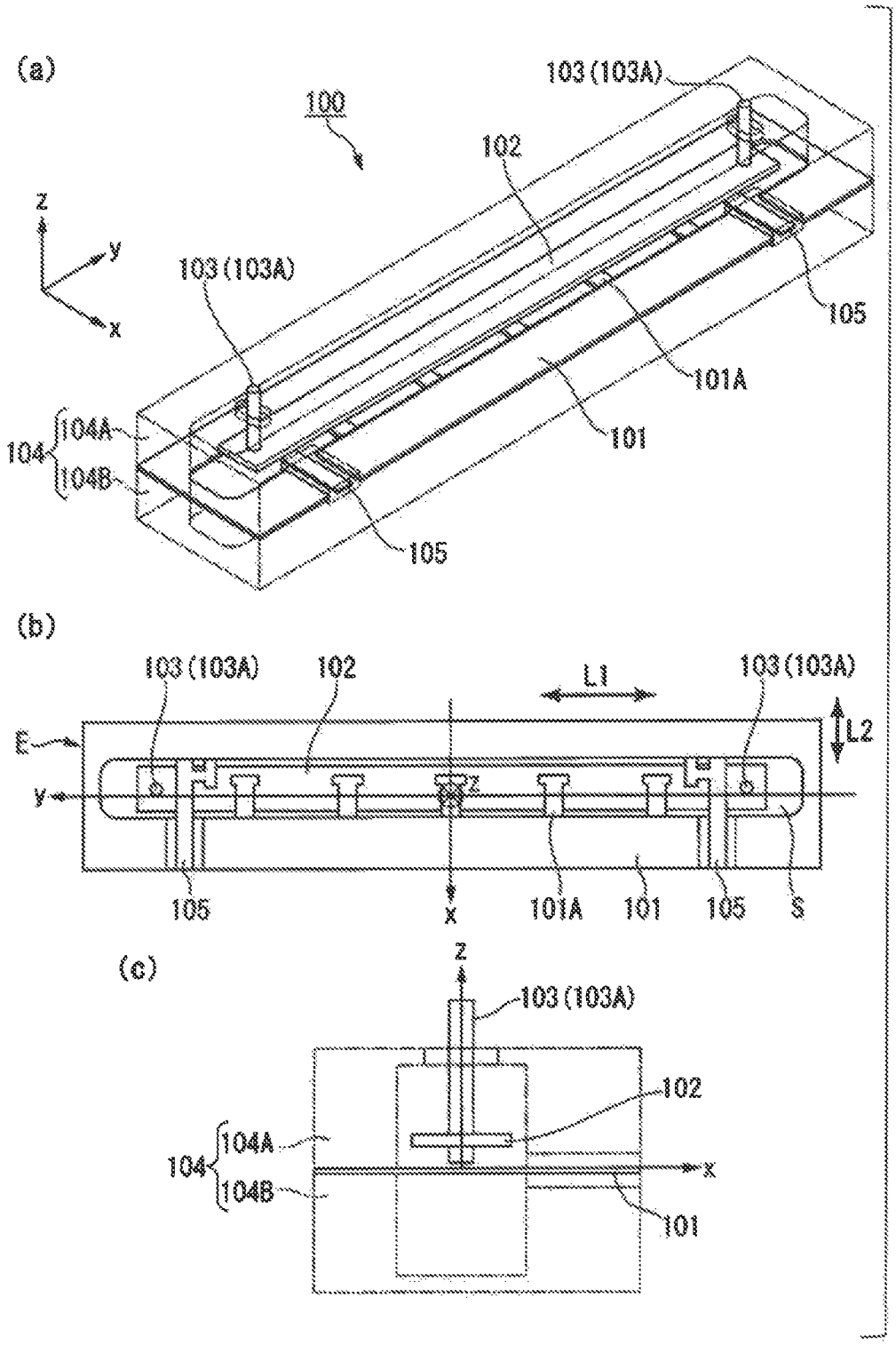
FIG. 1 and views (a), (b) and (c) are respectively a perspective view, a bottom view and a side view of a tunable bandpass filter according to a first example embodiment of the present invention.

A configuration of a tunable bandpass filter according to a first example embodiment of the present invention will be described. FIG. 1 view (a) is a perspective view of a tunable bandpass filter 100 according to the example embodiment. The tunable bandpass filter 100 includes: a conductive member 101 including a plurality of resonance rods 101A; a dielectric plate 102; a driving unit 103 for driving the dielectric plate 102; and a waveguide 104 containing at least the resonance rods 101A and the dielectric plate 102.

The shape of the conductive member 101 is not limited but is preferably a flat plate-shaped member. In the following example, it is assumed that the conductive member 101 is a metallic plate. The plurality of resonance rods 101A are aligned in a single plane and protrude from the conductive member 101. The principal surface of the conductive member 101 as a metallic plate is preferably approximately parallel to the single plane in which the resonance rods 101A are aligned. The conductive member 101 consists, for example, of a material such as brass. While a similar material is used for the resonance rods 101A, the resonance rods 101A each preferably consist of the same material as that of the conductive member 101.

The dielectric plate 102 has a principal surface thereof disposed parallel to the single plane in which the resonance rods 101A are aligned, and simultaneously covers at least the tip portions of all resonance rods 101A, that is, the portions that are farthest from the conductive member 101. When the conductive member 101 is a metallic plate, as in this example embodiment, the principal surface of the dielectric plate 102 is preferably also parallel to that of the metallic plate. Thickness of the dielectric plate 102 is preferably about 0.5 [mm] to 3.0 [mm]. Materials of the dielectric plate 102 preferably include low-loss materials such as alumina. Teflon (registered trademark), and forsterite.

The waveguide 104 contains at least the resonance rods 101A and the dielectric plate 102 and consists of a metallic material such as copper or aluminum. FIG. 1(*a*) illustrates an example configuration where the waveguide 104 is divided, by the metallic plate 101, into two portions, a portion (upper portion) 104A including the dielectric plate 102 and an opposite portion (lower portion) 104B.

FIG. 1 view (b) is a bottom view of the tunable bandpass filter 100 of FIG. 1 view (a) as viewed from the side where the dielectric plate 102 is not disposed (bottom side of FIG. 1 view (a)). In FIG. 1 view (b), the waveguide 104 as an external conductor is illustrated see-through in such a way that the structure of the conductive member 101 will be clarified. The plurality of resonance rods 101A are aligned in a direction approximately parallel to the longitudinal direction L1 of the waveguide 104 in a space S enclosed by the waveguide 104.

While an input/output unit 105 has a coaxial structure in the example embodiment, the input/output unit 105 is not limited to this structure but may function as an interface of a device, for example a waveguide, including the input/output unit 105.

FIG. 1 view (c) is a side view of the tunable bandpass filter 100 of FIG. 1 view (a) as viewed from one end E in the longitudinal direction L1 of the waveguide 104 (left side in FIG. 1 view (b)). In order to clarify the structure of the dielectric plate 102 and the driving unit 103, the waveguide 104 is illustrated see-through also in FIG. 1 view (c).

The driving unit 103 is attached to the dielectric plate 102 and drives the dielectric plate 102 in directions parallel and perpendicular to the single plane in which the resonance rods 101A are aligned.

A particular example of the driving unit 103 may include, as illustrated in FIGS. 1 view (a) and view (c), a rod-shaped member 103A as a support rod or a support member attached to the dielectric plate 102. The rod-shaped member 103A in this example is preferably disposed at least in two points on the dielectric plate 102 from the viewpoint of stability, and is more preferably disposed in the vicinity of both ends of the dielectric plate 102 in the longitudinal direction. FIG. 1 view (c) illustrates an example where the longitudinal direction of the dielectric plate 102 is approximately parallel to the longitudinal direction L1 of the waveguide, that is, a direction in which the plurality of resonance rods 101A are aligned. The rod-shaped member 103A may penetrate the dielectric plate 102 as illustrated in FIG. 1 view (c).

The rod-shaped member 103A may be driven manually or by connecting a movable unit (not illustrated), such as a biaxially controllable actuator, to the rod-shaped member 103A and operating the movable unit.

Operation of the tunable bandpass filter 100 will be described in a qualitative manner. A coordinate system used for description is defined as follows. A direction perpendicular to the principal surface of the dielectric plate 102 is assumed as the z direction. A direction parallel to the principal surface of the dielectric plate 102 and the longitudinal direction L2 of the resonance rod 101A is assumed as the x direction and a direction perpendicular to the longitudinal direction L2 is assumed as the y direction. In other words, it is assumed that the plurality of resonance rods 101A are aligned in the y direction.

In the tunable bandpass filter 100, the bandwidth widens and the center frequency becomes lower as the dielectric plate 102 approaches the tip of the resonance rod 101A, that is, the farthest portion from the conductive member 101. In the filter 100, the bandwidth narrows and the center frequency becomes higher as the dielectric plate 102 approaches the base of the resonance rod 101A, that is, the neatest portion to the conductive member 101.

In other words, when the dielectric plate 102 is driven only in the x direction, both the bandwidth and the center frequency change and it is impossible to control only the bandwidth. However, when the dielectric plate 102 is driven in the z direction, only the center frequency changes. In an alternative approach, the bandwidth is controlled to have a predetermined value by driving the dielectric plate 102 in the x direction and then the center frequency that changes with the bandwidth is corrected by driving the dielectric plate 102 in the z direction. This approach changes only the bandwidth while keeping the center frequency constant.

Note that the center frequency is not necessarily constant. When the center frequency is to be changed in a proactive manner depending on the bandwidth, it is possible to make correction by driving the dielectric plate 102 in the z direction.

When the bandwidth and the center frequency are each known as a function of position, the dielectric plate 102 may be moved simultaneously in the x and z directions in such a way that a desired bandwidth and center frequency will be obtained.

Figure 2:
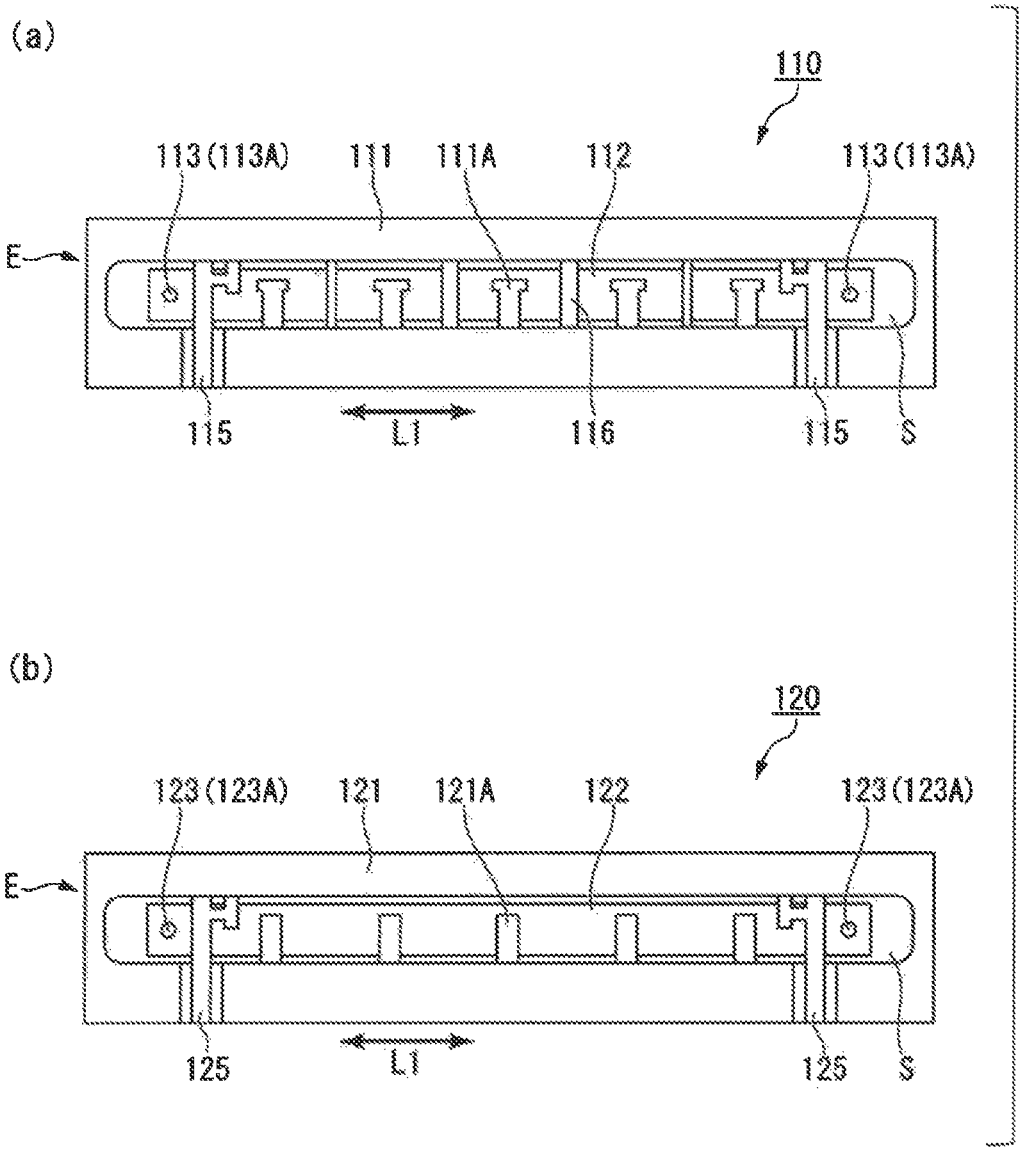
FIG. 2 and views (a) and (b) are bottom views of variations of the tunable bandpass filter according to the first example embodiment of the present invention.

FIGS. 2 view (a) and view (b) are bottom views of variations of the tunable bandpass filter 100. Note that, in FIG. 2, reference signs 111, 121 indicate conductive members, reference signs 112, 122 dielectric plates, reference signs 113, 123 driving units, reference signs 113A, 123A rod-shaped members, and reference signs 115, 125 input/output units.

The tunable bandpass filter according to the example embodiment may include a coupling plate 116 having a predetermined width in accordance with the bandwidth to be designed, disposed between adjacent resonance rods 111A, like a tunable bandpass filter 110 illustrated in FIG. 2 view (a). The coupling plate 116 is used to determine a standard passband width of the filter.

The shape of a resonance rod is not limited to the T-shape illustrated in FIG. 1 view (b) since the resonance rod resonates at a predetermined frequency. For example, the resonator rod may be in a linear shape, like a resonance rod 121A of a tunable bandpass filter 120 illustrated in FIG. 2 view (b).

As mentioned above, the tunable bandpass filter 100 (110, 120) according to the example embodiment is capable of adjusting the position of the dielectric plate 102 with respect to the resonance rod 101A by driving, through use of an actuator or the like, the driving unit 103 attached to the dielectric plate 102. The driving unit 103 is capable of adjusting the position of the dielectric plate 102 in two directions, that is, directions parallel and perpendicular to the principal surface of the dielectric plate 102. The driving unit 103 is capable of controlling the bandwidth through position adjustment in parallel direction and the center frequency through position adjustment in perpendicular direction. Thus, the tunable bandpass filter 100 according to the example embodiment is capable of changing only the bandwidth while keeping the center frequency constant.

The tunable bandpass filter 100 (110, 120) according to the example embodiment is designed to control the bandwidth only through position adjustment of the dielectric plate 102 (112, 122). Accordingly, even when a plurality of filters of different bandwidths are integrated into a single filter, it is unnecessary to adjust individual filters by using coupling adjusting screws as opposed to the related art, which offers a simple structure with reduced number of components.

The tunable bandpass filter 100 (110, 120) according to the example embodiment is designed in such a way as not to use a variable capacitance element like a varactor diode in the control of the bandwidth, which reduces generation of losses.

Second Example Embodiment

A configuration of a tunable bandpass filter 200 according to a second example embodiment of the present invention will be described.

Figure 3:
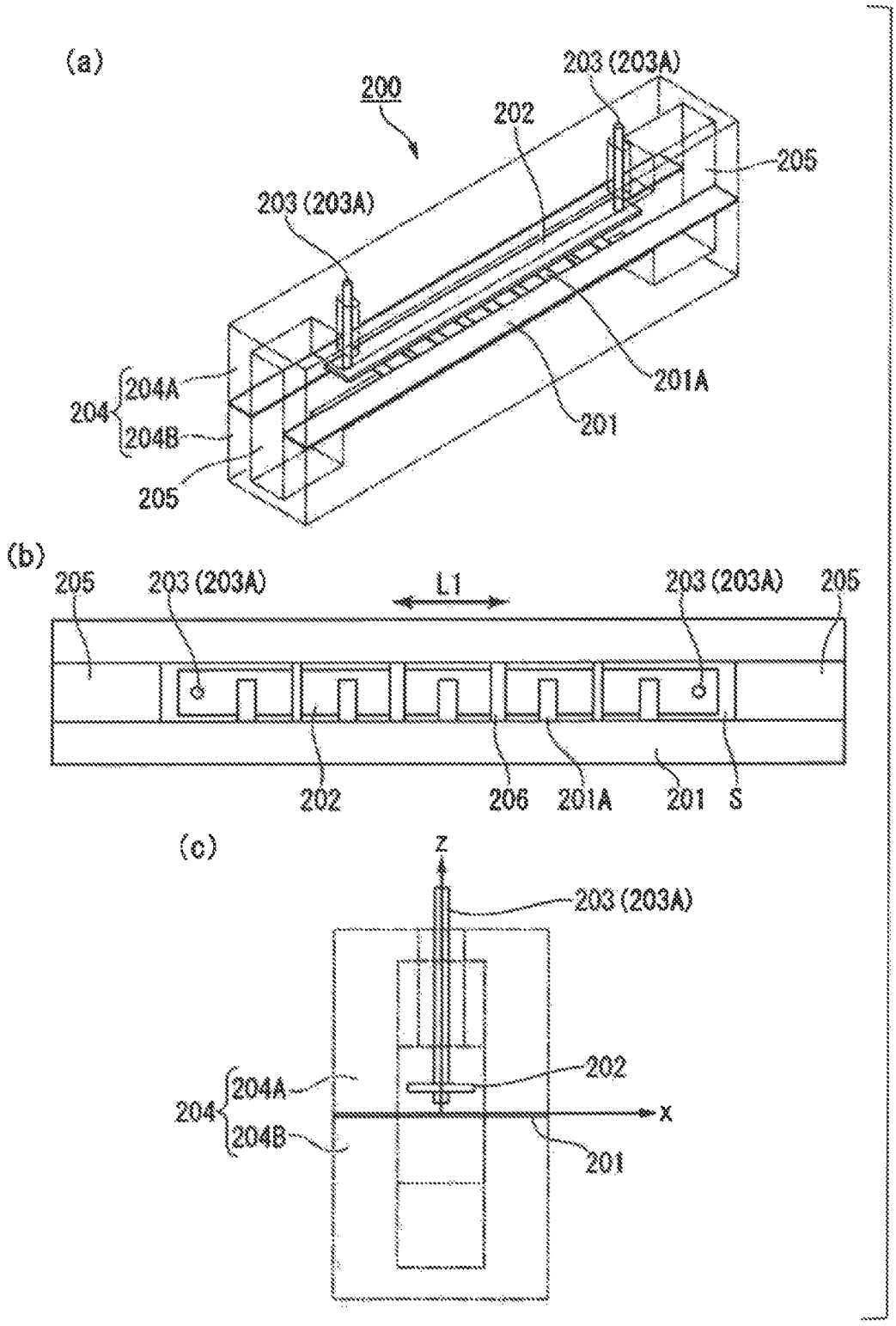
FIG. 3 and views (a), (b) and (c) are respectively a perspective view, a bottom view and a side view of a tunable bandpass filter according to a second example embodiment of the present invention.

FIG. 3 view (a) is a perspective view of the tunable bandpass filter 200 according to the example embodiment.

FIG. 3 view (b) is a bottom view of the tunable bandpass filter 200 of FIG. 3 view (a) as viewed from the side where a dielectric plate 202 is not disposed (bottom side of FIG. 3 view (a)). In FIG. 3 view (b), a waveguide 204 as an external conductor is illustrated see-through in order to clarify the structure of a conductive member 201.

FIG. 3 view (c) is a side view of the tunable bandpass filter 200 of FIG. 3 view (a) as viewed from one end of the waveguide 204 in the longitudinal direction L1. In order to clarify the structure of the dielectric plate 202 and a driving unit 203, the waveguide 204 is also illustrated see-through in FIG. 3 view (c).

Note that, in FIG. 3, a reference sign 201A indicates a resonance rod, a reference sign 203A a rod-shaped member, reference signs 204A, 204B respectively a portion including the dielectric plate 202 and an opposite portion, a reference sign 205 an input/output unit, and a reference sign 206 a coupling plate.

The input/output unit of the tunable bandpass filter 200 in the example embodiment is a waveguide interface. An opening is disposed at either end of the waveguide 204 in the longitudinal direction L1 and these openings perform the input/output function of the filter. Configuration of the other portions is similar to that of the tunable bandpass filter 100 according to the first example embodiment and thus an equivalent effect to that of the first example embodiment is obtained.

Third Example Embodiment

A configuration of a tunable bandpass filter 300 according to a third example embodiment of the present invention will be described.

Figure 4:
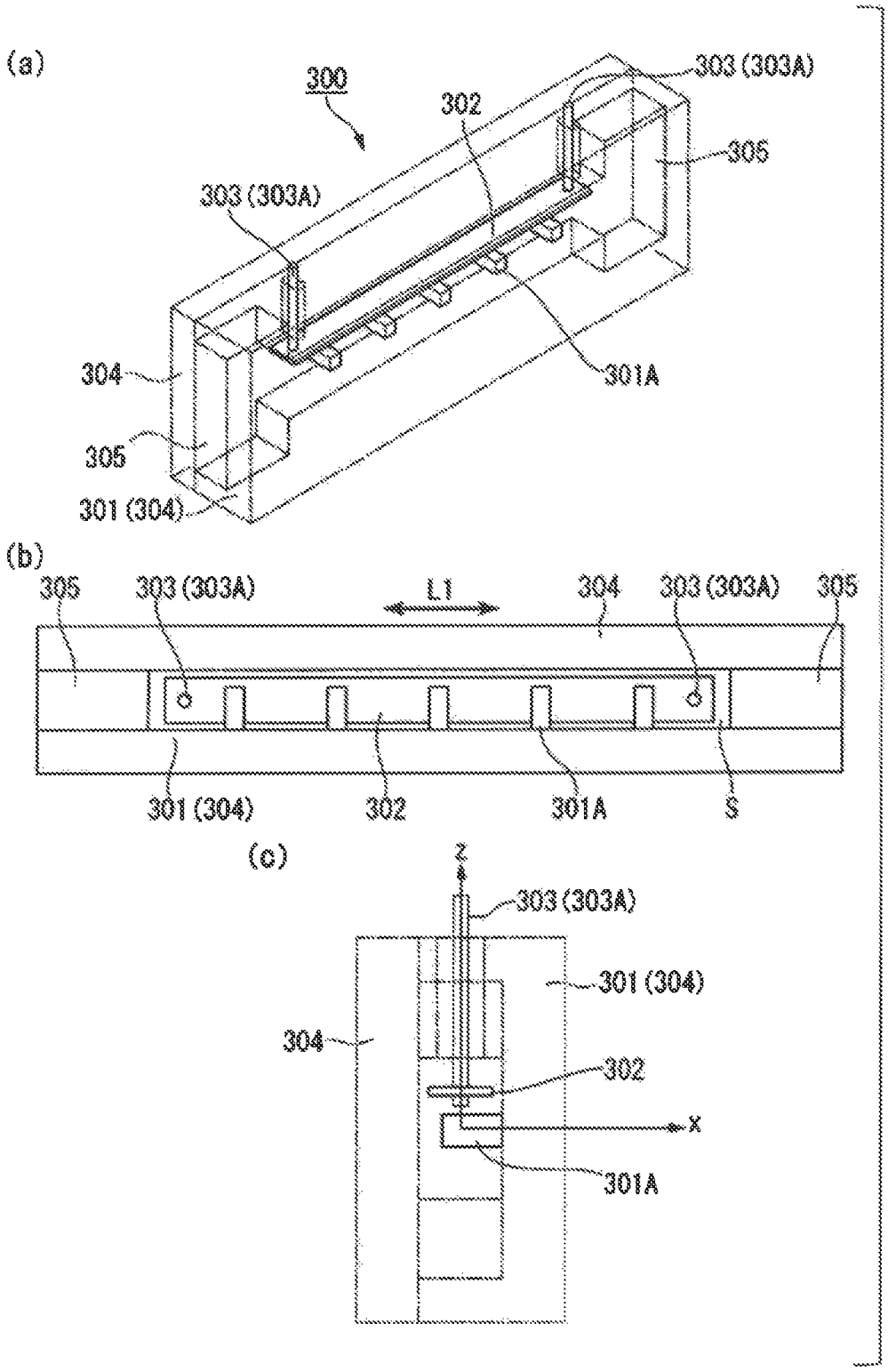
FIG. 4 and views (a), (b) and (c) are respectively a perspective view, a bottom view and a side view of a tunable bandpass filter according to a third example embodiment of the present invention.

FIG. 4 view (a) is a perspective view of the tunable bandpass filter 300 according to the example embodiment.

FIG. 4 view (b) is a bottom view of the tunable bandpass filter 300 of FIG. 4 view (a) as viewed from the side where a dielectric plate 302 is not disposed (bottom side of FIG. 4 view (a)). In FIG. 4 view (b), a waveguide 304 as an external conductor is illustrated see-through in order to clarify the structure of a conductive member 301.

FIG. 4 view (c) is a side view of the tunable bandpass filter 300 of FIG. 4 view (a) as viewed from one end of the waveguide 304 in the longitudinal direction L1. In order to clarify the structure of the dielectric plate 302 and a driving unit 303, the waveguide 304 is also illustrated see-through in FIG. 4 view (c).

Note that, in FIG. 4, a reference sign 303A indicates a rod-shaped member, and a reference sign 305 an input/output unit.

The tunable bandpass filter 300 is designed in such a way as not to use a metallic plate illustrated in the first and second example embodiments, and each resonance rod 301A is integral with the member 301 (304), which constitutes an external conductor or a waveguide, in the base portion thereof. In other words, in the example embodiment, the member 301 (304) constituting the external conductor plays the role of the metallic plate in the first and second example embodiments. In the example embodiment, similarly to the second example embodiment, an opening is disposed at either end of the member 301 (304) in the longitudinal direction L1 and these openings perform the input/output function of the filter. Configuration of the other portions is similar to that of the tunable bandpass filter 100 according to the first example embodiment and thus an equivalent effect to that of the first example embodiment is obtained.

Fourth Example Embodiment

A configuration of a tunable bandpass filter according to a fourth example embodiment of the present invention will be described. The tunable bandpass filter according to the example embodiment includes: a conductive member; a resonance rod protruding from one surface of the conductive member; a dielectric plate disposed parallel to the one surface; a driving unit for driving the dielectric plate in directions parallel and perpendicular to the one surface; and a waveguide containing at least the resonance rod and the dielectric plate.

Configuration of the example embodiment differs from that of the other example embodiments in that use of a single resonance rod is allowed. Configuration of the other portions is similar to that of the other example embodiments. Thus, also in the example embodiment, a similar effect to that of the aforementioned example embodiments is obtained.

EXAMPLE

The effect of the present invention will be further clarified with reference to examples. Note that the present invention is not limited to the following examples but may be modified as appropriate without departing from the spirit thereof.

Operation of the tunable bandpass filter 100 will be described, with reference to FIG. 1 view (b) and view (c), by taking an example case where the tunable bandpass filter 100 is a five-stage bandpass filter for the 8 GHz band. Coordinate axes x, y, z used in the following description are set as follows.

(Setting of Coordinate Axes)

A single plane in which the resonance rods 101A are aligned is assumed as an xy plane and a z-axis is set perpendicularly to the xy plane. It is assumed that a side of the z-axis where the dielectric plate 102 is disposed is in a positive direction and the opposite side in a negative direction.

In the single plane in which the resonance rods 101A are aligned, an x-axis is set parallel to the longitudinal direction L2 of the resonance rod 101A. It is assumed that a base side of the resonance rod 101A, that is, the nearest portion to a conductive member 101, is in a positive direction, and a tip side of the resonance rod 101A, that is, the farthest portion from the conductive member 101, is in a negative direction.

In the single plane in which the resonance rods 101A are aligned, a y-axis is set in a longitudinal direction L1 of a waveguide, that is, in a direction in which the resonance rods 101A are aligned. It is assumed that one end in the longitudinal direction L1 (right side in FIG. 1 view (b)) is in a negative direction and the opposite end side in a positive direction.

It is assumed that the x-axis, y-axis and z-axis intersect each other in a center position in the longitudinal direction L1 of the waveguide, the center position overlapping the center portion of a range where the dielectric plate 102 is operable in the single plane in which the resonance rods 101A are aligned. It is assumed that the position is the origin of the coordinate axes.

Example 1

Simulation has been performed on a 3 dB bandwidth of the tunable bandpass filter 100, that is, the bandwidth between points 3 dB lower than the peak of a passing waveform, obtained when the dielectric plate 102 illustrated in FIG. 1 view (c) is moved in the x direction by using the driving part 103.

Figure 5:
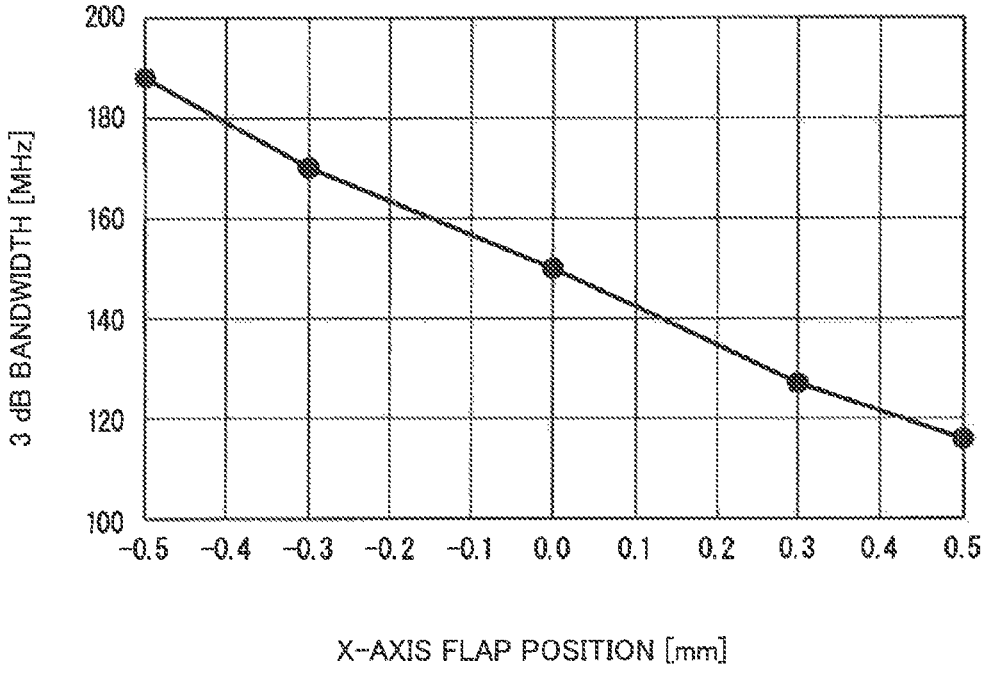
FIG. 5 is a graph illustrating a characteristic of the tunable bandpass filter according to the first example embodiment of the present invention.

FIG. 5 is a graph illustrating the result of the simulation. In the graph, the horizontal axis indicates the position of the dielectric plate 102 in the x direction (FLAP position on the x-axis) [mm] and the vertical axis indicates the 3 dB bandwidth [MHz]. Note that the position of the dielectric plate refers to the center position or coordinates on the principal surface of the dielectric plate.

As understood from the graph in FIG. 5, the bandwidth widens as the dielectric plate 102 approaches the tip of the resonance rod 101A or moves in the negative x direction, and on the other hand, the bandwidth narrows as the dielectric plate 102 approaches the base of the resonance rod 101A, or moves in the positive x direction. This result indicates a characteristic of the 3 dB bandwidth to change continuously in proportion to the travel distance of the dielectric plate 102 in the x direction. Thus, it is possible to control the bandwidth, through use of this characteristic, by adjusting the position of the dielectric plate in the x direction.

Example 2

As illustrated in FIG. 1 view (c), the frequency dependence of insertion loss is measured that is obtained when the dielectric plate 102 is moved in the x and z directions.

Figure 6:
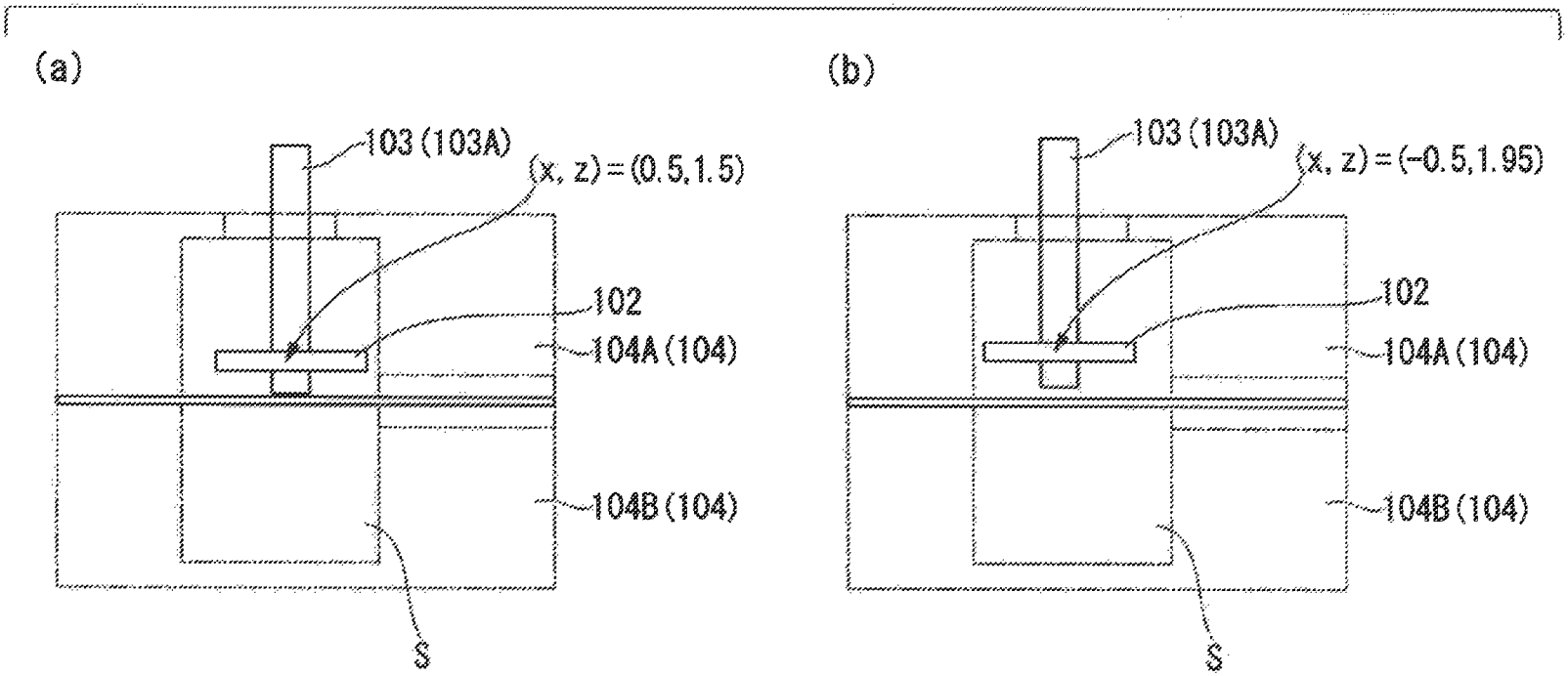
FIG. 6 and views (a) and (b) are side views of the tunable bandpass filter in operation according to the first example embodiment of the present invention.

FIG. 6 view (a) illustrates a state where the dielectric plate 102 is moved by +0.5 [mm] in the x direction and +1.5 [mm] in the z direction from the coordinate axes origin. FIG. 6 view (b) illustrates a state where the dielectric plate 102 is moved by −0.5 [mm] in the x direction and +1.95 [mm] in the z direction from the coordinate axes origin.

In the state illustrated in FIG. 6 view (a), considering only the influence of the travel in the x direction, the position of the dielectric plate 102 is closer by +0.5 [mm] to the base of the resonance rod 101A or in the positive x direction and the center frequency in the position of the dielectric plate 102 is higher than that at the coordinate axes origin. On the other hand, in the state illustrated in FIG. 6 view (b), considering only the influence of the travel in the x direction, the position of the dielectric plate 102 is closer by −0.5 [mm] to the tip of the resonance rod 101A or in the negative x direction and the center frequency in the position of the dielectric plate 102 is lower than that at the coordinate axes origin. In other words, the center frequency differs depending on the position of the dielectric plate 102 on the x-axis or x-coordinate of the same.

However, in the example embodiment, it is possible to change only the center frequency without changing the bandwidth, by moving the dielectric plate 102 in the z direction. Thus, a combination of moving in the x direction and moving in the z direction controls only the bandwidth while keeping the center frequency constant. For example, the bandwidth is controlled to have a predetermined value by driving the dielectric plate 102 in the x direction and then the center frequency that changes with the bandwidth is corrected by driving the dielectric plate 102 in the z direction. This approach changes only the bandwidth while keeping the center frequency constant.

Figure 7:
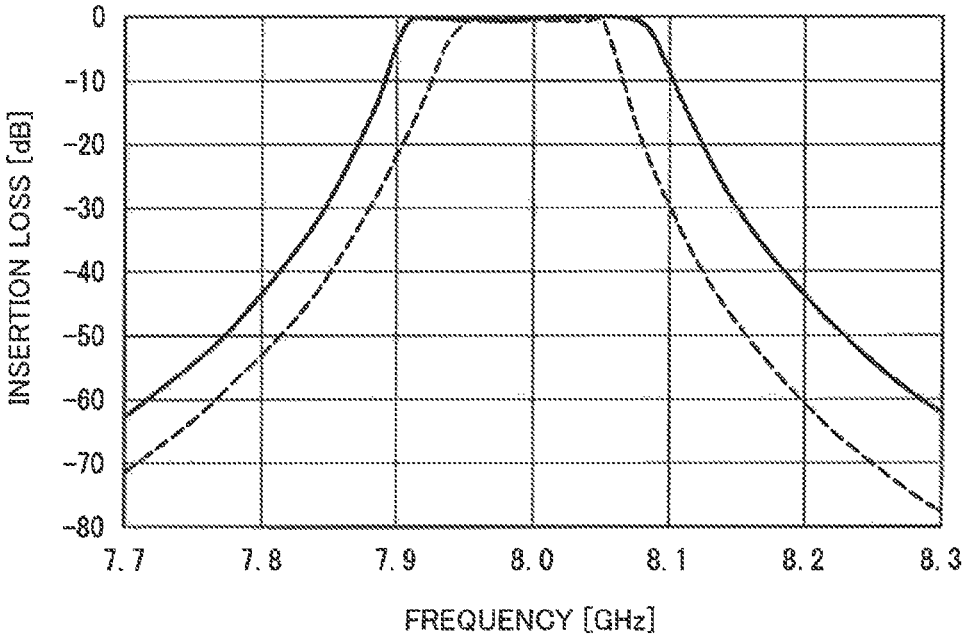
FIG. 7 is a graph illustrating a characteristic of the tunable bandpass filter according to the first example embodiment of the present invention.

FIG. 7 is a graph illustrating the frequency dependence of insertion loss of the tunable bandpass filter 100 in the state illustrated in FIG. 6 view (a) and view (b). In the graph, the horizontal axis indicates a frequency [GHz] and the vertical axis an insertion loss [dB]. In the graph, a broken line corresponds to the state in FIG. 6 view (a) and a solid line corresponds to the state in FIG. 6 view (b).

According to the graph in FIG. 7, the 3 dB bandwidth in the state in FIG. 6 view (a) is 116 [MHz] and the 3 dB bandwidth in the state in FIG. 6(*b*) is 188 [MHz]. According to the graph in FIG. 7, the center frequency is the same between the state in FIG. 6 view (a) and the state in FIG. 6 view (b). The average value of the bandwidth is 152 MHz, and when the state is changed from the state in FIG. 6 view (a) to the state in FIG. 6 view (b), the change in bandwidth is calculated as (188-116) divided by 152, that is, about 47 [%]. This result demonstrates that the present invention substantially changes the bandwidth while keeping the center frequency constant.

While example embodiments and examples of the present invention have been described in detail with reference to drawings, the present invention is not limited to the aforementioned configurations but various design changes or the like are possible.

INDUSTRIAL APPLICABILITY

The present invention is applicable to, for example, microwave or millimeter-wave communications.

REFERENCE SIGNS LIST

100, 110, 120, 200, 300 Tunable bandpass filter
101, 111, 121, 201, 301 Conductive member
101A, 111A, 121A, 201A, 301A Resonance rod
102, 112, 122, 202, 302 Dielectric plate
103, 113, 123, 203, 303 Driving unit
103A, 113A, 123A, 203A, 303A Rod-shaped member
104, 204, 304 Waveguide
104A, 204A Upper portion of waveguide
104B, 204B Lower portion of waveguide
105, 115, 125, 205, 305 Input/Output unit of waveguide
116, 206 Coupling plate
E One end of waveguide
L1 Longitudinal direction of waveguide
L2 Longitudinal direction of resonance rod
S Space enclosed by waveguide

The invention claimed is:

1. A tunable bandpass filter comprising:
a conductive member including a plurality of resonance rods protruding in such a way as to be aligned in a single plane;
a dielectric plate disposed parallel to the single plane;
a driving unit, attached to the dielectric plate, for driving the dielectric plate in directions parallel and perpendicular to the single plane; and
a waveguide containing at least the resonance rods and the dielectric plate.

2. The tunable bandpass filter according to claim 1, wherein the conductive member is a metallic plate and wherein a surface of the conductive member is disposed parallel to the principal surface of the dielectric plate.

3. The tunable bandpass filter according to claim 1, wherein the waveguide is divided into two portions across the conductive member.

4. The tunable bandpass filter according to claim 1, wherein the conductive member is integral with the waveguide.

5. The tunable bandpass filter according to claim 1, wherein the dielectric plate consists of alumina.

6. The tunable bandpass filter according to claim 1, wherein a coupling plate is disposed between the adjacent resonance rods.

7. The tunable bandpass filter according to claim 1, wherein the driving unit includes a support member attached to the dielectric plate.

8. A tunable bandpass filter comprising:
a conductive member;
a resonance rod protruding from one surface of the conductive member;
a dielectric plate disposed parallel to the one surface;
a driving unit for driving the dielectric plate in directions parallel and perpendicular to the one surface; and
a waveguide containing at least the resonance rod and the dielectric plate.

* * * * *